US005239962A

United States Patent [19]

Fukui et al.

[11] Patent Number: 5,239,962

[45] Date of Patent: Aug. 31, 1993

[54] ENGINE CONTROL APPARATUS FOR A MULTI-CYLINDER ENGINE

[75] Inventors: Wataru Fukui; Hideki Umemoto, both of Himeji, Japan

[73] Assignee: Mitsubishi Denki Kabushiki Kaisha, Tokyo, Japan

[21] Appl. No.: 898,004

[22] Filed: Jun. 16, 1992

[30] Foreign Application Priority Data

Jun. 19, 1991 [JP] Japan ..... 3-147490
Jun. 26, 1991 [JP] Japan ..... 3-154399

[51] Int. Cl.[5] ..... F02P 5/15; F02P 7/067; F02D 41/26

[52] U.S. Cl. ..... 123/414; 123/476; 123/617

[58] Field of Search ..... 123/414, 476, 612, 613, 123/617, 643

[56] References Cited

U.S. PATENT DOCUMENTS

| | | | |
|---|---|---|---|
| 4,338,903 | 7/1982 | Bolinger | 123/476 |
| 4,457,286 | 7/1984 | Katayama et al. | 123/643 X |
| 4,485,784 | 12/1984 | Fujii et al. | 123/643 X |
| 4,494,518 | 1/1985 | Katayama et al. | 123/643 X |
| 4,499,875 | 2/1985 | Katayama et al. | 123/414 X |
| 4,664,092 | 5/1987 | Kaufmann | 123/643 |
| 4,788,956 | 12/1988 | Suzuki et al. | 123/414 |

*Primary Examiner*—Willis R. Wolfe

*Attorney, Agent, or Firm*—Sughrue, Mion, Zinn, Macpeak and Seas

[57] ABSTRACT

An engine control apparatus for a multi-cylinder engine is provided which precisely controls a plurality of groups of cylinders on the basis of a plurality of reference position sensors, each of which senses a reference crank position of a corresponding group of cylinders. The apparatus generates control signals for controlling the plurality of groups of cylinders even in the event of a failure of any one of the sensors thus providing a fail-safe operation. The sensors generate output signals, in synchronization with the crankshaft, which are feed to an OR gate which generates a single output signal each time a signal is received from the sensors. The output signal from the OR gate is feed to an interrupt terminal of a microcomputer whereupon the latter starts an interrupt processing which identifies the group of cylinders corresponding to the output signal and generates control signals. In another form, a rotation sensor successively senses a rotational angle of a ring gear which rotates in synchronism with the crankshaft and generates a pulse signal which is counted by a counter. The counter generates an output signal indicative of a counted number. The microcomputer generates control signals based upon the output signal of the counter as well as the output signals from the sensors. In the event of a failure of any one of the sensors, the microcomputer generates control signals based on the output signals from the other normally operating sensors.

17 Claims, 5 Drawing Sheets

ENGINE CONTROL APPARATUS FOR A MULTI-CYLINDER ENGINE

BACKGROUND OF THE INVENTION

The present invention relates to an engine control apparatus for simultaneously controlling a plurality of cylinders of an internal combustion engine on the basis of a plurality of cylinder-group identifying signals. More particularly, it relates to such an engine control apparatus which can utilize a simple and inexpensive control unit in the form of a microcomputer.

A typical example of such an engine control apparatus is illustrated in FIG. 5. The apparatus illustrated is to control a multi-cylinder engine having six cylinders which are grouped into three paris. In FIG. 5, the engine includes a crankshaft 1 which performs two revolutions per engine cycle for each cylinder including an intake stroke, a compression stroke, a combustion stroke and an exhaust stroke. An arcuate-shaped reference position indicating member 2, which is formed, for example, from a magnetic material, is mounted on the crankshaft 1 and has a forward or leading end 2*a* and a rearward or trailing end 2*b* corresponding, respectively, to two crank angle reference positions. A plurality (three in the illustrated example) of reference position sensors 3 each comprising an electromagnetic pickup are disposed around the outer peripheral surface of the crankshaft 1 at equal circumferential intervals (e.g., at an angle of 120 degrees in the illustrated example) in such a manner that they can be placed in a face-to-face relation with respect to the reference position indicating member 2 during the rotation of the crankshaft 1. Thus, each of the sensors 3 generates an output signal in the form of a cylinder-group identifying signal S1, S2 or S3 each time it faces the reference position indicating member 2 during rotation thereof, as shown in FIG. 6.

A controller 4 generates, based on the cylinder-group identifying signals S1 through S3, control signals comprising an ignition signal E and a fuel injection signal F for corresponding groups of cylinders. The controller 4 includes a control unit in the form of a microcomputer 41 having a plurality of interrupt terminals INT1 through INT3 to which cylinder-group identifying signals S1 through S3 from the corresponding reference position sensors 3 are respectively input, and an output interface 42 from which the ignition signal E and the fuel injection signal F generated by the microcomputer 41 are output to an ignition coil 5 and an injection coil 6.

The ignition coil 5 includes a primary winding 5*a* and a secondary winding 5*b* and generates a high voltage across the secondary winding 5*b* when an ignition signal E generated by the controller 4 is input to the primary winding 5*a*. When the controller 4 generates a fuel injection signal F, the injection coil 6 is energized to drive an unillustrated injector for injecting fuel to an unillustrated intake manifold of the engine.

Though not shown, each of the cylinders is provided with an intake valve and an exhaust valve which are driven to open and close through a valve operating mechanism in synchronization with the rotation with the crankshaft 1 for supplying an air/fuel mixture to each cylinder and discharging exhaust gases therefrom.

The operation of the above-described engine control apparatus will now be described below with particular reference to a waveform diagram of FIG. 6. As the engine starts to operate, the reference position sensors 3 generate cylinder-group identifying signals S1 through S3 each for a corresponding group of cylinders, respectively, in synchronization with the rotation of the crankshaft 1. As depicted in FIG. 5, each of the cylinder-group identifying signals S1 through S3 includes a pulse which rises when the corresponding reference position sensor 3 is placed in a face-to-face relation with the leading end 2*a* of the reference position indicating member 2 (i.e., at a first reference position A), and which falls when the corresponding reference position sensor 3 is placed in a face-to-face relation with the trailing end 2*b* of the reference position indicating member 2 (i.e., at a second reference position B). The first and second reference positions A and B can arbitrarily be set, for example, to a crank angle near a conduction or power supply starting timing of the ignition coil 5 and another crank angle near a conduction or power supply cut-off timing thereof, respectively.

Upon the rising of a pulse of the cylinder-group identifying signal S1, i.e., when an interrupt signal S1 is input to the interrupt terminal INT1 of the microcomputer 41, the microcomputer 41 initiates an interrupt processing whereby it generates an ignition signal E and a fuel injection panel F for a first group of two cylinders. At this time, one of the two cylinders to be controlled by these signals E, F is in the combustion stroke whereas the other cylinder is in the intake stroke, so only the one cylinder undergoing the combustion stroke is fired to perform combustion of a mixture therein whereas the other cylinder in the intake stroke remains unchanged upon firing, causing no combustion. Similarly, other groups (i.e., a second group and a third group) of cylinders are sequentially controlled in accordance with cylinder-group identifying signals S2, S3, respectively.

With the above-described engine control apparatus, however, the controller 4 including the microcomputer 41 having the plurality of interrupt terminals INT1 through INT3 corresponding to the plurality of cylinder-group identifying signals S1 through S3, respectively, is expensive, thus making it difficult to cut down the manufacturing costs.

Moreover, if one of the reference position sensors 3 fails during the operation of the engine, a corresponding one of the cylinder-group identifying signals S1 through S3 can no longer be provided. In this case, the controller 4 or the microcomputer 41 identifies, based on no input of an interrupt signal to a corresponding interrupt input terminal, a group of cylinders corresponding to the failed reference position sensor 3 and performs fail-safe control on this group of cylinders. For example, if a cylinder-group identifying signal S2 for the second group of cylinders is not provided, the controller 4 controls these cylinders on the basis of an interrupt signal in the form of a first cylinder-group identifying signal S1. In this case, however, there is a relatively long period of time from the time of generation of the first cylinder identification signal S1 until the time when the second group of cylinders are actually controlled, thus giving rise to a relatively large error or time lag in control timing. In other words, since the controller 4 generates control signals E and F based solely upon cylinder-group identifying signals S1 through S3 from the reference position sensors 3, it is difficult to backup a failure of any of the reference position sensors 3 is a reliable manner.

SUMMARY OF THE INVENTION

Accordingly, the present invention is intended to obviate the above-noted problems encountered with the above-described engine control apparatus.

An object of the invention is to provide a novel and improved engine control apparatus in which an inexpensive controller can be used to cut down the manufacturing costs.

Another object of the invention is to provide a novel and improved engine control apparatus which can backup a failure of any reference position sensor through the utilization of a pulse signal from a rotation sensor which senses the rotational position of a crankshaft.

In order to achieve the above objects, according to one aspect of the invention, there is provided an engine control apparatus for controlling a multi-cylinder engine having a plurality of groups of cylinders, the apparatus comprising: crank angle sensing means for sensing a reference crank position for each cylinder group and generating a corresponding output signal for each cylinder group; and a controller connected to receive output signals from the crank angle sensing means for controlling the cylinder based thereon. The controller comprises: an OR gate connected to receive output signals from the crank angle sensing means for generating a single output signal each time an output signal from the crank angle sensing means is input to the OR gate; and a control unit having a single interrupt terminal connected to receive an output signal from the OR gate and a plurality of input ports connected to receive output signals from the crank angle sensing means, respectively, the control unit being triggered to initiate an interrupt processing to identify operating conditions of one of the groups of the cylinders on the basis of output signals from the crank angle sensing means fed to the input ports of the control unit and to generate a control signal for controlling the group of cylinders thus identified.

According to another aspect of the invention, there is provided an engine control apparatus for controlling a multi-cylinder engine having a plurality of groups of cylinders, the apparatus comprising: crank angle sensing means for sensing a reference crank position for each cylinder group and generating a corresponding output signal for each cylinder group; and rotation sensing means for successively sensing a plurality of rotational positions of a crankshaft of the engine during the rotation thereof and generating a pulse signal each time it senses any one of the rotational positions of the crankshaft; a controller connected to receive output signals from the crank angle sensing means and the rotation sensing means for controlling the cylinders based thereon. The controller comprises: a counter connected to receive output signals from the crank angle sensing means and the rotation sensing means for counting the number of pulses generated by the rotation sensing means in response to an output signal from the crank angle sensing means and generating an output signal indicative of a counted value; and a control unit connected to receive output signals from the crank angle sensing means and the counter for generating the control signal based on these signals.

In one form of the invention, the controller further comprises an OR gate connected to receive output signals from the crank angle sensing means for generating a single output signal each time an output signal from the crank angle sensing means is input to the OR gate; and the counter has a clock input terminal connected to receive an output signal from the rotation sensing means and a reset terminal connected to receive an output signal from the OR gate so that each time an output signal from the OR gate is input to the reset terminal of the counter, the counter is thereby reset to start counting the number of pulses generated by the rotation sensing means; and the control unit has a single interrupt terminal connected to receive an output signal from the OR gate and a plurality of input ports connected to receive output signals from the crank angle sensing means and the rotation sensing means, respectively, the control unit being triggered by an output signal from the OR gate to initiate an interrupt processing to identify operating conditions of one of the groups of the cylinders on the basis of output signals from the crank angle sensing means fed to the input ports of the control unit and to generate a control signal for controlling the group of cylinders thus identified on the basis of output signals from the crank angle sensing means and the counter.

In another form of the invention, the counter has a clock input terminal connected to receive an output signal from the rotation sensing means and a reset terminal connected to receive output signals from the crank angle sensing means so that each time an output signal from the crank angle sensing means is input to the reset terminal of the counter, the counter is thereby reset to start counting the number of pulses generated by the rotation sensing means; and the control unit has a plurality of interrupt terminals respectively connected to receive output signals from the crank angle sensing means, and an input port connected to receive an output signal from the counter, the control unit being triggered by each output signal from the rotation sensing means to initiate an interrupt processing to identify operating conditions of one of the groups of the cylinders on the basis of output signals from the crank angle sensing means fed to the interrupt terminals of the control unit and to generate a control signal for controlling the group of cylinders thus identified on the basis of output signals from the crank angle sensing means and the counter.

Preferably, if any of the reference position sensors fails, the control unit generates a control signal for controlling the group of cylinders corresponding to the failed reference position sensor on the basis of output signals from the remaining normally operating reference position sensors and an output signal from the rotation sensing means.

Preferably, if the rotation sensing means fails, the control unit generates a control signal for controlling the groups of cylinders on the basis of output signals from the crank angle sensing means.

The above and other objects, features and advantages of the invention will more readily apparent from the ensuing detailed description of preferred embodiments of the invention taken along the accompanying drawings.

BRIEF DESCRIPTION OF THE DRAWINGS

In the drawings, the same symbols identify the same of corresponding parts.

DESCRIPTION OF THE PREFERRED EMBODIMENTS

Preferred embodiments of the present invention will now be described in detail while referring to the accompanying drawings.

Figure 1:
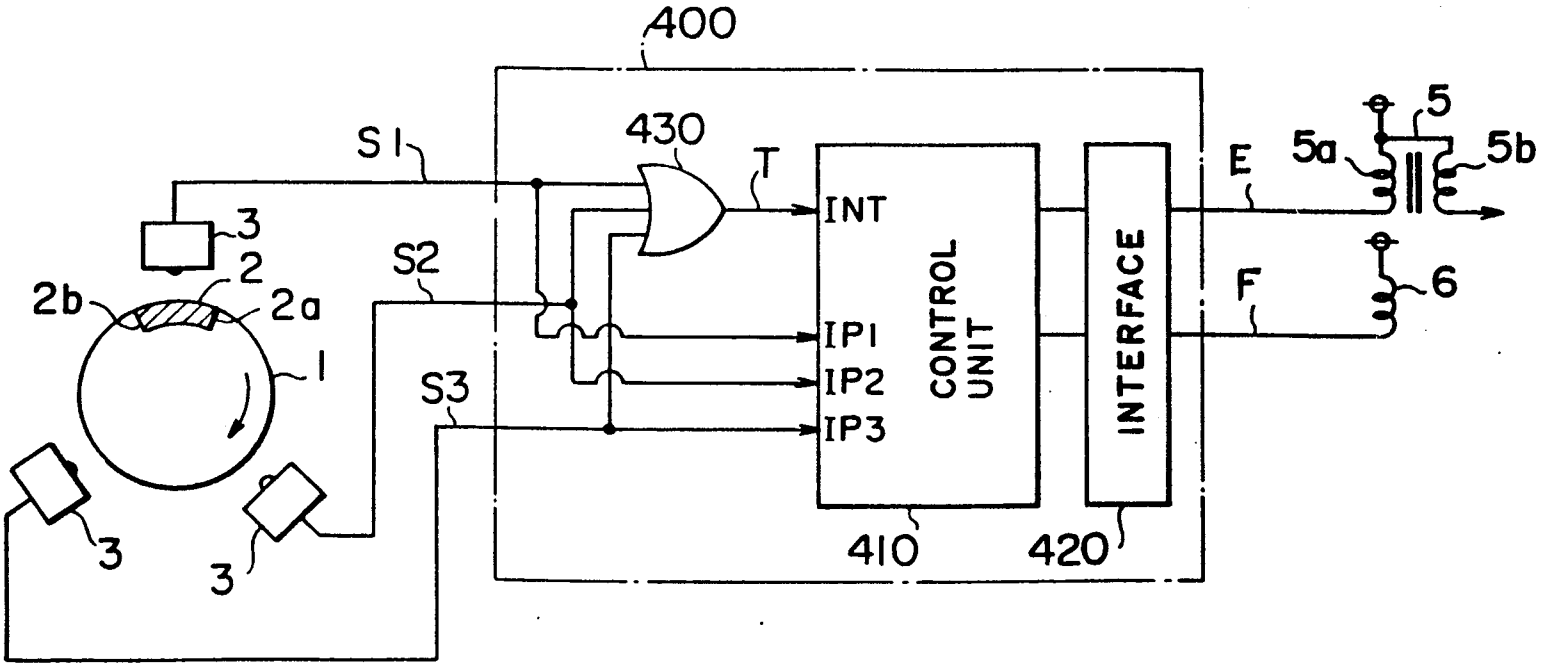
FIG. 1 shows the general construction of an engine control apparatus in accordance with one embodiment of the invention.
Figure 5:
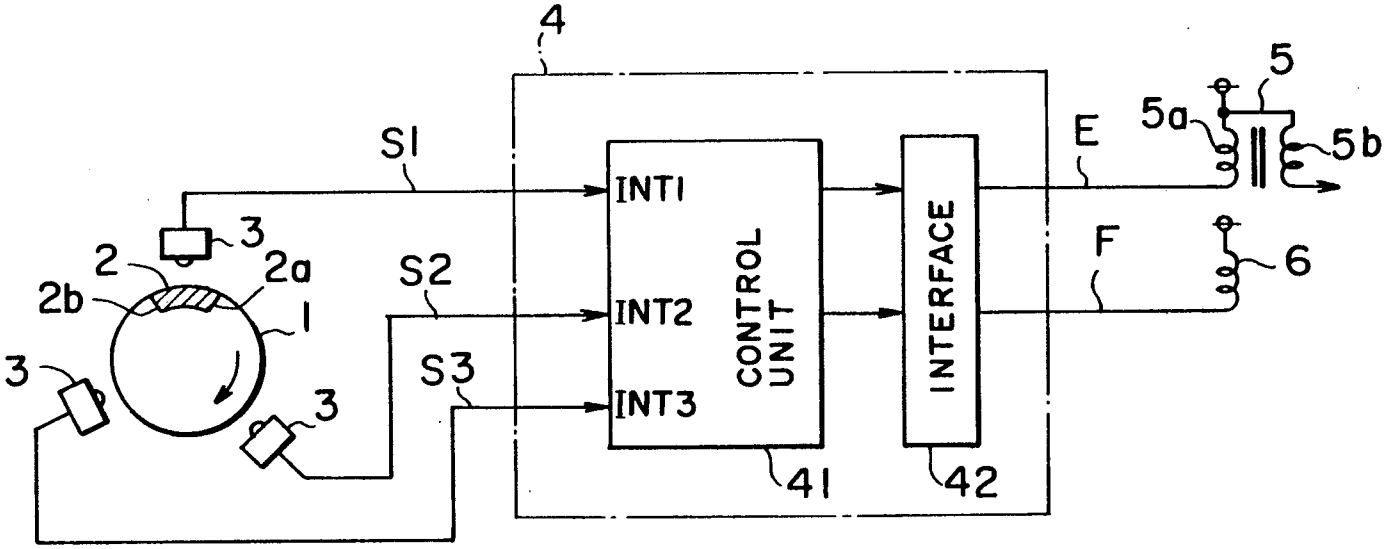
FIG. 5 shows the general construction of a typical example of an engine control apparatus.

FIG. 1 shows an engine control apparatus constructed in accordance with a first embodiment of the invention. The apparatus illustrated includes elements 1 through 8 which are the same as the corresponding elements 1 through 8 of FIG. 5 except for a controller 400. Specifically, the controller 400 of this embodiment comprises a control unit in the form of a microcomputer 410 having a single interrupt terminal INT and a plurality (e.g., three in the illustrated embodiment) of input ports IP1 through IP3, to which output signals in the form of cylinder-group identifying signals S1 through S3 from the plurality (i.e., three in the illustrated embodiment) of reference position sensors 3 are input, for generating an ignition signal E and/or a fuel injection signal F, an output interface 420 connected to the ignition coil 5 and the injection coil 6 for outputting thereto the ignition signal E and the fuel injection signal F, respectively, and an OR gate 430 having a plurality (e.g., three in the illustrated embodiment) of input terminals connected to the plurality of reference position sensors 3, respectively, and a single output terminal connected to the interrupt terminal INT of the microcomputer 410. The OR gate 430 generates an interrupt signal T when any one of the reference position sensors 3 generates a cylinder-group identifying signal S1, S2 or S3.

Figure 2:
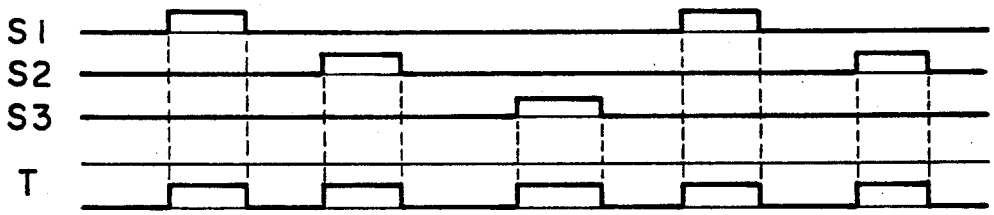
FIG. 2 is a waveform diagram showing the waveforms of various signals used in the invention.
Figure 6:
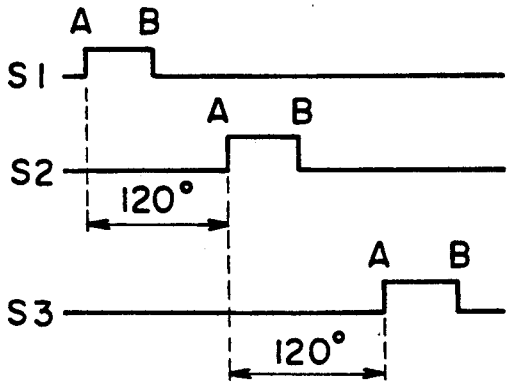
FIG. 6 is a waveform diagram showing the waveforms of various control signals used in the apparatus of FIG. 5.

The operation of this embodiment will be described below with particular reference to the waveform diagram of FIG. 2. As the engine begins to operate, the reference position sensors 3 generate, in synchronism with the rotation of the crankshaft 1, cylinder-group identification signals S1 through S3, respectively, as in the apparatus of FIG. 5, which are depicted at S1 through S3 in FIG. 2. These signals S1 through S3 are input to the corresponding input terminals of the OR gate 430 which then generates a single output signal T, as depicted at T in FIG. 2, which is input to the single interrupt terminal INT of the microcomputer 410. Simultaneously with this, the output signals S1 through S3 from the reference position sensors 3 are also input to the corresponding input ports IP1 through IP3 of the microcomputer 410 which then identifies the operational condition or state of each group of cylinders based on the signal levels at the respective input ports IP1 through IP3. For example, when the level of one of the output signals S1 through S3 input to the input ports IP1 through IP3 is high, the microcomputer 410 determines that a corresponding group of cylinders are in specific operating states, i.e., in the combustion or intake stroke.

More specifically, when an interrupt signal T is input to the interrupt terminal INT (i.e., the signal level at the interrupt terminal INT is high), the microcomputer 410 initiates an interrupt processing for identifying the operating states or strokes of the cylinders and controlling the ignition as well as fuel injection for these cylinders. That is, when the cylinder-group identifying signal S1 has a high level with the other cylinder-group identification signals S2 and S3 being at a low level, the input signal level at the input port IP1 is high and those at IP2 and IP3 are low (i.e., signal level data at the input ports is "100", 1 for IP1, 0 for IP2, and 0 for IP3), so the microcomputer 410 determines that the first group of cylinders corresponding to the cylinder-group identifying signal S1 are in the specific operating states, i.e., in the combustion or intake stroke, and then it generates an ignition signal E to the ignition coil 5 for controlling the ignition timing of the first group of cylinders and/or a fuel injection signal F to the injection coil 6 for controlling the fuel injection timing for the first group of cylinders. Thereafter, every time an interrupt signal T is input to the interrupt terminal INT of the microcomputer 410, the microcomputer 410 initiates an interrupt routine whereby the operating states of a corresponding group of cylinders are identified based on data about the levels of signals input to the input ports IP1 through IP3, and then ignition control and/or fuel injection control are performed for the identified group of cylinders. In this regard, if the signal level at the second or third input port IP2 or IP3 is high (i.e., signal level data at the input ports is "010" or "001"), it is determined that the corresponding second or third group of cylinders are in the specific operating states, i.e., in the combustion or intake stroke.

On the other hand, if one of the reference position sensors 3 has failed for some reason and thus generates no output signal S2, the OR gate 430 generates no interrupt signal T corresponding to the absence of an output signal S2 from the failed reference position sensor 3, so that signal level data obtained at the input ports IP1 through IP3 changes from "100" into "001" or vice versa during a series of cylinder group identifying operations in comparison with the case of normal cylinder identifying operations in which signal level data sequentially changes like "100" (for high S1), "010" (for high S2), "001" (for high S3). Thus, from the pattern of changing of signal level data at the input ports IP1 through IP3, the microcomputer 410 can not only determine whether there is a failure in any of the reference position sensors 3 but can also locate which member is in failure. If a failure of any one of the reference position sensors 3 is determined and located, then the microcomputer 410 controls ignition and fuel injection for the group of cylinders corresponding to the failed reference position sensor 3 based on the output signals from the other normally operating reference position sensors.

According to the above embodiment, the microcomputer 410, which is inexpensive because of the provision of the single interrupt terminal INT alone, can be employed, substantially reducing the manufacturing costs of the entire apparatus. With respect to the plurality of input ports IP1 through IP3, even such an inexpensive microcomputer 410 can generally have room for providing an arbitrary number of input ports at very low cost.

Figure 3:
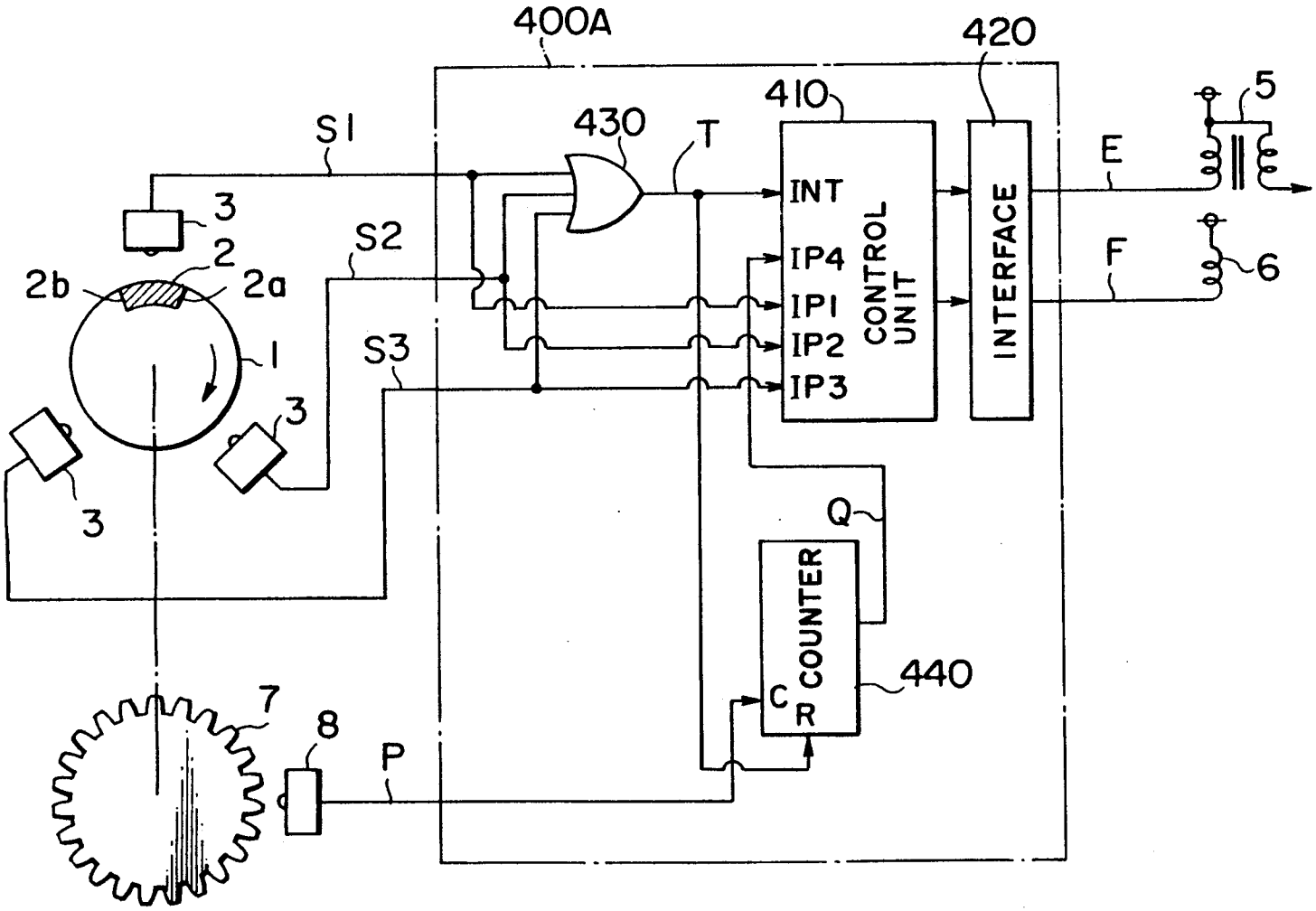
FIG. 3 is a view similar to FIG. 1, but showing another embodiment of the invention.

FIG. 3 illustrates another embodiment of the invention which is substantially similar in construction and operation to the previous embodiment of FIG. 1 except for the following. A ring gear 7 having a plurality of gear teeth circumferentially formed on the outer peripheral surface thereof is disposed in alignment with the crankshaft 1 in synchronized rotation therewith. A rotation sensor 8 is disposed near the ring gear 7 so as to face one of the teeth on the outer periphery of the ring gear 7 for successively sensing the gear teeth during rotation of the ring gear 7 and generating a pulse signal comprising a series of pulses each corresponding to one of the gear teeth. A controller 400A includes, in addition to a microcomputer 410, an output interface 420 and an OR gate 430 all of which are the same as those of FIG. 1, a counter 440 which has a clock input terminal C connected to receive an output signal P from the rotation sensor 8, a reset terminal connected to receive an output signal T from the OR gate 430, and an output terminal connected to an input terminal IP4 of the microcomputer 410. When an interrupt signal T generated by the OR gate 430 is input to the reset terminal R of the counter 440, the counter 440 is thereby reset to start counting the number of output pulses P from the rotation sensor 8 and generating a counted value to the control unit 410, the counting continuing until the following interrupt signal T is input to the reset terminal R. The construction and arrangement of this embodiment other than the above are substantially the same as those of FIG. 1.

Next, the operation of this embodiment will be described below. As the engine starts to operate, the reference position sensors 3 respectively generate cylinder-group identification signals S1 through S3, as in the previous embodiment of FIG. 1, which are input to the OR gate 430. The OR gate 430 generates an interrupt signal T, as shown at T in FIG. 2, which is concurrently input to the interrupt terminal INT of the microcomputer 410 and to the reset terminal R of the counter 440. With rotation of the crankshaft 1, the ring gear 7 mounted thereon rotates in synchronism therewith so that the rotation sensor 8 generates an output pulse P each time it faces one of the teeth of the ring gear 7. The output pulse P from the rotation sensor 8 is input to the clock input terminal C of the counter 440. When an interrupt signal T from the OR gate 430 is input to the reset terminal R, the counter 440 starts counting the output pulses P from the rotation sensor 8 until the following interrupt signal T is input to the reset terminal R. Upon every input of an interrupt signal T, the counter 440 generates an output signal Q indicative of the counted value to the microcomputer 410.

As referred to in the previous embodiment, when an interrupt signal T is input to the interrupt terminal INT of the microcomputer 410, the microcomputer 410 initiates an interrupt processing so that it identifies the operating states of a group of cylinders based on the levels of input signals at the input ports IP1 through IP3. As a result of this identification, the microcomputer 410 generates an ignition signal E and/or a fuel injection signal F for controlling the ignition timing and the fuel injection timing for the thus identified group of cylinders. In this regard, the microcomputer 410 can generate the ignition signal E and the fuel injection signal F at respective timings or instants at which the counted value of the counter 440 reaches respective prescribed or desired values. Such timing control is highly precise since the output or generating timings or instants of the ignition signal and the fuel injection signal are determined on the basis of the count of pulses P generated by the rotation sensor 8 in exact correspondence to the actual rotation of the ring gear 7 and hence of the crankshaft 1.

However, if any of the reference position sensors 3 has failed to generate an output signal, the microcomputer 410 identifies this failure based on a change in the data of the input signal levels at the input ports IP1 through IP3, as previously described in detail with reference to the embodiment of FIG. 1. In this case, the OR gate 430 generates no output signal T in correspondence to the absence of an output signal from the failed reference position sensor 3, and the microcomputer 410 generates control signals E and F for the group of cylinders corresponding to the failed reference position sensor 3 based on the counter value of the counter 440. That is, the microcomputer 410 generates these control signals E and F at respective timings or instants at which the value Q of the counter 440 counted from the input of a previous interrupt signal T (i.e., from the time when a cylinder identifying signal output from a normally operating reference position sensor 3 rises) reaches respective prescribed or desired values. This fail-safe or backup control based on the count of pulses P corresponding to the actual rotation of the crankshaft 1 is much more precise then the case in which control signals are generated by measuring the time from the rising of a cylinder-group identifying signal.

Furthermore, in the event that the rotation sensor 8 fails, the microcomputer 410 can generate control signals E and F based on the output signals S1 through S3 from the reference position sensors 3 in the same manner as in the embodiment of FIG. 1. In this case, if one of the reference position sensors 3 fails in addition to the failure of the rotation sensor 8, the microcomputer 410 can generate control signals E and F based on the output signals from the normally operating reference position sensors 3, as in the previous embodiment of FIG. 1, thus ensuring fail-safe operation of the apparatus.

In the foregoing embodiments, the number of reference position sensors 3 can be varied depending upon the number of groups of cylinders, and likewise the number of input ports can be accordingly varied to match the number of reference position sensors 3.

Although in this embodiment, the microcomputer 410 having the single interrupt terminal INT is employed, another microcomputer having a plurality of interrupt terminals can also be used while providing substantially the same advantages of the fail-safe or backup function as well as improved control accuracy by use of a pulse signal P from the rotation sensor 8.

Figure 4:
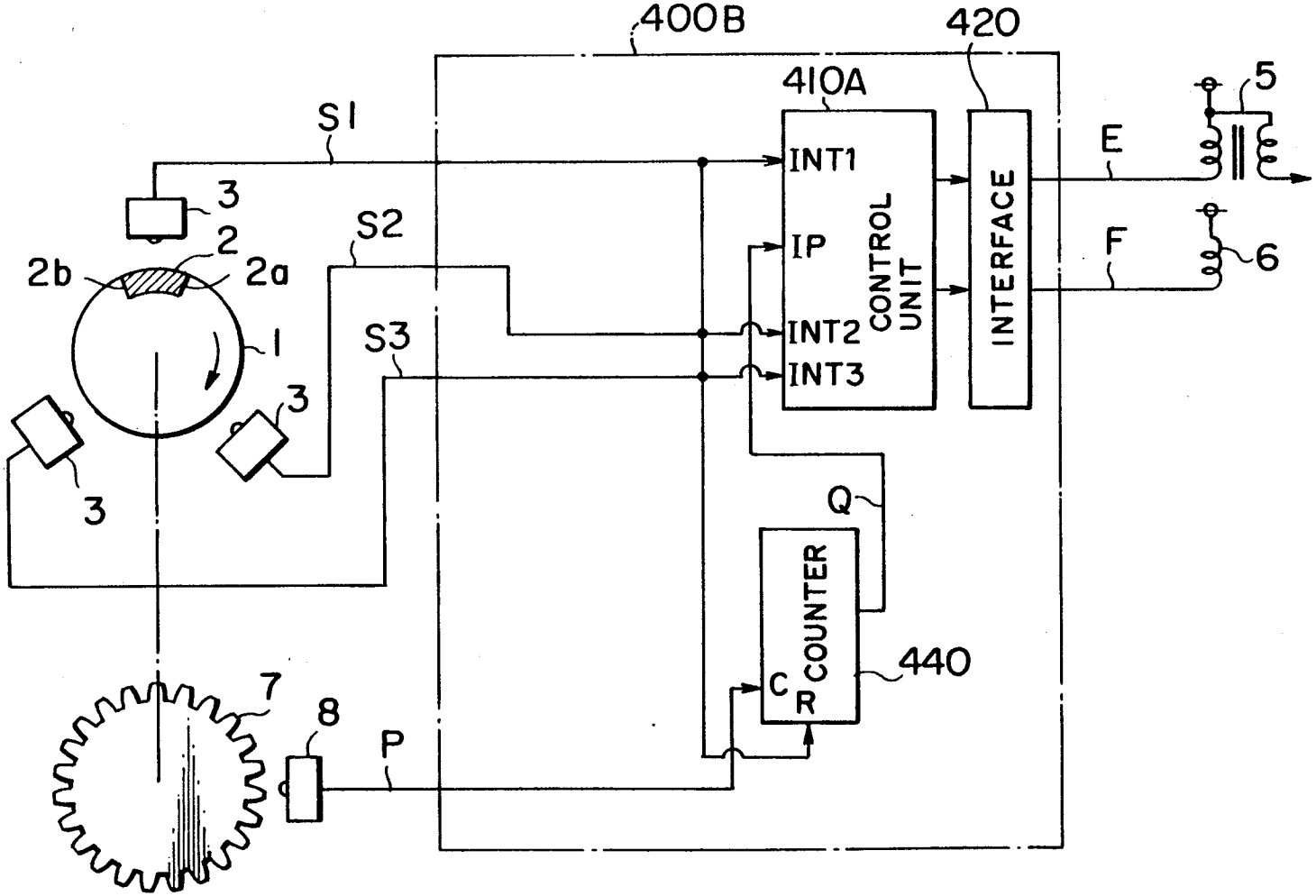
FIG. 4 is a view similar to FIG. 1, but showing a further embodiment of the invention.

To this end, FIG. 4 shows a further embodiment of the invention which is substantially similar to the embodiment of FIG. 3 except for the following. Namely, the controller 400B is constructed as follows. The OR gate 430 of FIG. 3 is omitted, and a control unit in the form of a microcomputer 410A is provided with a plurality (e.g., three in the illustrated embodiment) of interrupt terminals INT1 through INT3 which are directly connected to a plurality of corresponding reference position sensors 3, respectively. A counter 440 has a clock terminal C connected to a rotation sensor 8, a reset terminal R to which output signals from the reference position sensors 3 are input, and an output terminal connected to an input port IP of the control unit 410A. The construction and arrangement of this embodiment other than the above are substantially the same as those of the embodiment of FIG. 3.

With this embodiment, each time an output signal from one of the reference position sensors 3 is input to a corresponding one of the interrupt terminals INT1 through INT3 of the microcomputer 410A, the microcomputer 410A starts an interrupt processing for identifying the operational state of each group of cylinders and generating control signals such as an ignition signal E and a fuel injection signal F. In this case, too, based on the levels of input signals at the interrupt terminals INT1 through INT3, microcomputer 410A determines that a group of cylinders corresponding to an input signal of a high level at one of the interrupt terminals INT1 through INT3 is in specific operating states (i.e., the combustion stroke or intake stroke), and generates an ignition signal E and a fuel injection signal F for controlling the thus identified cylinder group at respective timings which are determined on the basis of the output signal Q from the counter 440. Specifically, upon input of an output signal from one of the reference position sensors 3 to the reset terminal R, the counter 440 is reset to start counting the number of pulses generated by the rotation sensor 8 and generating an output signal indicative of a counted value to the input port IP of the microcomputer 410A until it is again reset by the following output signal from the sensors 3. The microcomputer 410A generates an ignition signal E and a fuel control signal F at respective timings at which the counted value of the counter 440 reaches respective predetermined or desired values.

Moreover, in this embodiment, a failure of any of the reference position sensors 3 can be detected from a series of changes of the input signals levels at the interrupt terminals INT1 through INT3, as in the previous embodiments of FIGS. 1 and 3. In the event of a failure of one of the sensors 3, the microcomputer 410A generates control signals E and/or F based on output signals from the other normally operating sensors 3, as in the embodiment of FIG. 1, or based on these signals and an output signal Q from the rotation sensor 8, as in the embodiment of FIG. 3. Also, in the case of a failure of the rotation sensor 8, the microcomputer 410A can generate control signals E, F on the basis of output signals from the reference position sensors 3, as in the embodiment of FIG. 3.

In this embodiment, the number of reference position sensors 3 can be varied depending upon the number of groups of cylinders, and likewise the number of interrupt ports can be accordingly varied to match the number of reference position sensors 3.

What is claimed is:

1. An engine control apparatus for controlling a multi-cylinder engine having a plurality of groups of cylinders, said apparatus comprising:

crank angle sensing means for sensing a reference crank position for each cylinder group and generating a corresponding output signal for each cylinder group; and a controller connected to receive output signals from said crank angle sensing means for controlling said cylinders based thereon;

said controller comprising:

an OR gate connected to receive output signals from said crank angle sensing means for generating a single output signal each time an output signal from said crank angle sensing means is input to said OR gate; and a control unit having a single interrupt terminal connected to receive an output signal from said OR gate and a plurality of input ports connected to receive output signals from said crank angle sensing means, respectively, said control unit being triggered to initiate an interrupt processing to identify operating conditions of one of the groups of said cylinders on the basis of output signals from said crank angle sensing means fed to the input ports of said control unit and to generate a control signal for controlling the group of cylinders thus identified.

2. An engine control apparatus according to claim 1, wherein said crank angle sensing means comprises:

reference position indicating means being rotatable in synchronization with the rotation of a crankshaft of the engine for indicating a reference crank position for each group of cylinders; and a plurality of reference position sensors provided one for each group of cylinders so as to sense predetermined rotational positions of said position indicating means corresponding to the reference crank position for each cylinder.

3. An engine control apparatus according to claim 2, wherein said reference position indicating means is mounted on the crankshaft for rotation therewith, and said reference position sensors are disposed around the crankshaft at equal circumferential intervals so as to face said reference position indicating means when the later takes the predetermined rotational positions during rotation thereof.

4. An engine control apparatus according to claim 1, wherein the control signal generated by said control unit is an ignition signal for controlling the ignition timing for each group of cylinders.

5. An engine control apparatus according to claim 1, wherein the control signal generated by said control unit is a fuel injection signal for controlling the fuel injection timing for each group of cylinders.

6. An engine control apparatus according to claim 2, wherein if any of said reference position sensors fails, said control unit generates a control signal for controlling the group of cylinders corresponding to said failed reference position sensor on the basis of output signals from the remaining normally operating reference position sensors.

7. An engine control apparatus according to claim 1, further comprising:

a) rotation sensing means (7, 8) for successively sensing a plurality of rotational positions of a crankshaft of the engine during the rotation thereof and generating a pulse signal for each sensed position, and b) a counter (440) having a clock input coupled to an output of the rotation sensing means, a reset input coupled to the output of the OR gate, and a count output coupled to one of said input ports for enhancing the precision of the control signal.

8. An engine control apparatus for controlling a multi-cylinder engine having a plurality of groups of cylinders, said apparatus comprising:

crank angle sensing means (2, 3) for sensing a reference crank position for each cylinder group and generating a corresponding output signal for each cylinder group;

rotation sensing means (7, 8) for successively sensing a plurality of rotational positions of a crankshaft of the engine during the rotation thereof and generating a pulse signal each time it senses any one of the rotational positions of the crankshaft; and a controller (400A, 400B) connected to receive output signals from said crank angle sensing means and said rotation sensing means for controlling said cylinders based thereon;

said controller comprising:

a counter (440) connected to receive output signals from said crank angle sensing means at a reset terminal thereof and from said rotation sensing means at a clock terminal thereof for counting the number of pulses generated by said rotation sensing means in response to an output signal from said crank angle sensing means, and for generating an output signal indicative of a counted value upon each reset; and a control unit (410; 410A) connected to receive output signals from said crank angle sensing means, and to receive each output signal from said counter at an input port, for generating engine control signals based thereon.

9. An engine control apparatus according to claim 8, wherein said controller further comprises an OR gate connected to receive output signals from said crank angle sensing means for generating a single output signal each time an output signal from said crank angle sensing means is input to said OR gate; and said counter reset terminal is connected to receive an output signal from said OR gate so that each time an output signal from said OR gate is input to the reset terminal of said counter, said counter is thereby reset to start counting the number of pulses generated by said rotation sensing means; and said control unit has a single interrupt terminal connected to receive an output signal from said OR gate and a plurality of input ports connected to receive output signals from said crank angle sensing means and said counter, respectively, said control unit being triggered by an output signal from said OR gate to initiate an interrupt processing to identify operating conditions of one of the groups of said cylinders on the basis of output signals from said crank angle sensing means fed to the input ports of said control unit and to generate a control signal for controlling the group of cylinders thus identified on the basis of output signals from said crank angle sensing means and said counter.

10. An engine control apparatus according to claim 8, wherein said control unit has a plurality of interrupt terminals respectively connected to receive output signals from said crank angle sensing means, and an input port connected to receive an output signal from said counter, said control unit being triggered by each output signal from said crank angle sensing means to initiate an interrupt processing to identify operating conditions of one of the groups of said cylinders on the basis of output signals from said crank angle sensing means fed to the interrupt terminals of said control unit and to generate a control signal for controlling the group of cylinders thus identified on the basis of output signals from said crank angle sensing means and said counter.

11. An engine control apparatus according to claim 8, wherein if any of said crank angle sensing means fails, said control unit generates a control signal for controlling the group of cylinders corresponding to said failed crank angle sensing means on the basis of output signals from the remaining normally operating crank angle sensing means and an output signal from said rotation sensing means.

12. An engine control apparatus according to claim 8, wherein if said rotation sensing means fails, said control unit generates a control signal for controlling said groove of cylinders on the basis of output signals from said crank angle sensing means.

13. An engine control apparatus according to claim 8, wherein said crank angle sensing means comprises:

reference position indicating means being rotatable in synchronization with the rotation of the crankshaft for indicating a reference crank position for each group of cylinders; and a plurality of reference position sensors provided one for each group of cylinders so as to sense predetermined rotational positions of said position indicating means corresponding to the reference crank position for each cylinder.

14. An engine control apparatus according to claim 13, wherein said reference position indicating means is mounted on the crankshaft for rotation therewith, and said reference position sensors are disposed around the crankshaft at equal circumferential intervals so as to face said reference position indicating means when the latter takes the predetermined rotational positions during rotation thereof.

15. An engine control apparatus according to claim 8, wherein said rotation sensing means comprises:

a ring gear being rotatable in synchronization with the rotation with the crankshaft and having a plurality of gear teeth formed on the outer peripheral surface thereof at equal circumferential intervals; and a rotation sensor disposed near said ring gear so as to the teeth on the outer peripheral surface of said ring gear during rotation thereof for generating a pulse signal each time it faces one of the ring gear teeth.

16. An engine control apparatus according to claim 8, wherein the control signals generated by said control unit are ignition signals for controlling the ignition timing for each group of cylinders.

17. An engine control apparatus according to claim 8, wherein the control signals generated by said control unit are fuel injection signals for controlling the fuel injection timing for each group of cylinders.

* * * * *